US007701805B2

(12) United States Patent
Irino

(10) Patent No.: US 7,701,805 B2
(45) Date of Patent: Apr. 20, 2010

(54) TIME CORRECTION APPARATUS AND IMAGE FORMING DEVICE HAVING THE TIME CORRECTION APPARATUS

(75) Inventor: Yoshiaki Irino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 419 days.

(21) Appl. No.: 11/165,015

(22) Filed: Jun. 24, 2005

(65) Prior Publication Data

US 2005/0286347 A1 Dec. 29, 2005

(30) Foreign Application Priority Data

Jun. 25, 2004 (JP) ..... 2004-188588
May 27, 2005 (JP) ..... 2005-155235

(51) Int. Cl.
*G04C 11/02* (2006.01)

(52) U.S. Cl. ..... 368/21; 368/46

(58) Field of Classification Search ..... 368/21, 368/28, 46
See application file for complete search history.

(56) References Cited

U.S. PATENT DOCUMENTS

| | | | | |
|---|---|---|---|---|
| 4,866,611 | A * | 9/1989 | Cree et al. | 368/28 |
| 4,956,826 | A * | 9/1990 | Coyman et al. | 368/28 |
| 5,499,220 | A | 3/1996 | Ogasawara | |
| 5,845,257 | A * | 12/1998 | Fu et al. | 368/21 |
| 6,223,050 | B1 * | 4/2001 | Roberts, Jr. | 455/425 |
| 6,393,263 | B1 * | 5/2002 | Hayashi | 368/21 |
| 6,999,380 | B2 * | 2/2006 | Yamamoto | 368/10 |
| 7,031,696 | B2 * | 4/2006 | Gerrits et al. | 368/47 |
| 2002/0181333 | A1 | 12/2002 | Ito et al. | |
| 2003/0063316 | A1 | 4/2003 | Irino | |
| 2003/0074656 | A1 | 4/2003 | Irino | |
| 2005/0099993 | A1 * | 5/2005 | Ozawa | 370/350 |

FOREIGN PATENT DOCUMENTS

| | | |
|---|---|---|
| EP | 0 429 072 A | 5/1991 |
| EP | 1 293 895 A2 | 3/2003 |
| EP | 1 308 793 A1 | 5/2003 |
| FR | 2 784 760 A | 4/2000 |
| JP | 2001-42072 | 2/2001 |
| JP | 2001-142838 | 5/2001 |
| JP | 2001-175621 | 6/2001 |
| JP | 2001-186908 | 6/2001 |
| JP | 2001-318174 | 11/2001 |
| JP | 2001-350601 | 12/2001 |
| JP | 2002-63072 | 2/2002 |

(Continued)

*Primary Examiner*—Felix O Figueroa
(74) *Attorney, Agent, or Firm*—Oblon, Spivak, McClelland, Maier & Neustadt, L.L.P.

(57) ABSTRACT

In a time correction apparatus, a summer-time information holding unit holds summer-time information which contains an amount of input time as an amount of time correction for a summer time period. A transition time holding unit holds a plurality of summer time transition times of a plurality of years, which are computed beforehand from the summer-time information. A time determining unit compares the present time with each of the plurality of summer time transition times respectively, and determines whether the present time is within the summer time period based on a result of the comparison. A time correction unit corrects the present time for the summer time period by using the amount of input time, in accordance with a determination result by the time determining unit.

10 Claims, 4 Drawing Sheets

FOREIGN PATENT DOCUMENTS

| | | |
|---|---|---|
| JP | 2002-204280 | 7/2002 |
| JP | 2002-222081 | 8/2002 |
| JP | 2002-259190 | 9/2002 |
| JP | 2003-196110 | 7/2003 |
| JP | 2003-200620 | 7/2003 |
| JP | 2004-249667 | 9/2004 |
| JP | 2005-121396 | 5/2005 |

* cited by examiner

| 103a | |
|---|---|
| 133747200 | YEAR 2004 SUMMER TIME START DATE/TIME |
| 152499600 | YEAR 2004 SUMMER TIME END DATE/TIME |
| 165196800 | YEAR 2005 SUMMER TIME START DATE/TIME |
| 183949200 | YEAR 2005 SUMMER TIME END DATE/TIME |
| 196646400 | YEAR 2006 SUMMER TIME START DATE/TIME |
| 215398800 | YEAR 2006 SUMMER TIME END DATE/TIME |
| 228096000 | YEAR 2007 SUMMER TIME START DATE/TIME |
| 246848400 | YEAR 2007 SUMMER TIME END DATE/TIME |

TIME CORRECTION APPARATUS AND IMAGE FORMING DEVICE HAVING THE TIME CORRECTION APPARATUS

BACKGROUND OF THE INVENTION

1. Field of the Invention

The present invention relates to a time correction apparatus and an image forming device having the time correction apparatus in which the time correction apparatus determines whether the present time is within a summer time period, and performs time correction during the summer time.

2. Description of the Related Art

It is known that the summer time system is carried out in some countries and the standard time is set forward by one or two hours during the summer time. In connection with this, a conventional time correction apparatus which corrects the present time during the summer time is proposed for communication devices, such as facsimile devices, in which the time indication is performed or the automatic communication by a timer control is carried out.

Japanese Laid-Open Patent Application No. 2001-042072 discloses a time adjusting device and method which makes it possible to adjust time in the summer time period or in the other time period, without the need for the user to perform complicated operations, even if a summer time system will be provided in the future in the areas where the summer time system is not carried out at present.

Moreover, Japanese Laid-Open Patent Application No. 2001-318174 discloses an image forming device which causes the setting time of the timer function to be automatically corrected, when a change of the standard time zone and the summer time zone occurs, based on the time difference between the two time zones.

The amount of time correction in the summer time period is fixed to one hour in the conventional time correction apparatus, and if the summer time system in which the time correction requiring the amount of time correction other than one hour is adopted in the future, it is difficult for the conventional time correction apparatus to properly correct the present time during the summer time. Moreover, it is necessary to perform the complicated operations to modify the software provided in the image forming device, in order to properly correct the present time during the summer time.

In the case of the time correction apparatus disclosed in Japanese Laid-Open Patent Applications No. 2001-042072 and No. 2001-318174, the amount of time correction in the summer time period is fixed to one hour, and the present time is compared with the summer time start date/time and the summer time end date/time of the year concerned only. Namely, the determination as to whether the present time is within the summer time period is performed only for the year concerned.

Moreover, in the case of the above-mentioned time correction apparatus, it is determined whether the present time is within the summer time period of the year concerned only. When the continuous operation of the image forming device over two or more consecutive years is demanded, a faulty time correction may occur.

In order to avoid the problem and allow the continuous operation of the image forming device over two or more consecutive years, the time change should be monitored over the two or more consecutive years and the processing to update the summer time start date/time and the summer time end date/time year by year should be performed.

In the communication devices, such as facsimile devices, in which the time indication and the automatic communication by the timer control are performed, the time correction processing is performed frequently. However, in such cases, it is desired that the increasing of the CPU load due to the time correction processing be prevented.

SUMMARY OF THE INVENTION

An object of the present invention is to provide an improved time correction apparatus in which the above-described problems are eliminated.

Another object of the present invention is to provide a time correction apparatus which is capable of setting the amount of time correction for the summer time period to an arbitrary amount and correcting the present time properly even if a summer time system in which the time correction requiring the amount of time correction other than one hour is adopted, while there is no need for performing complicated operations to modify the software provided in the image forming device.

In order to achieve the above-mentioned objects, the present invention provides a time correction apparatus time correction apparatus provided for correcting a present time in an image forming device, the time correction apparatus comprising: a summer-time information holding unit holding summer-time information which contains an amount of input time as an amount of time correction for a summer time period; a transition time holding unit holding a plurality of summer time transition times of a plurality of years, which are computed beforehand from the summer-time information from the summer-time information holding unit; a time determining unit comparing the present time with each of the plurality of summer time transition times from the transition time holding unit, and determining whether the present time is within the summer time period based on a result of the comparison; and a time correction unit correcting the present time for the summer time period by using the amount of input time from the summer-time information holding unit, in accordance with a determination result by the time determining unit.

The above-mentioned time correction apparatus may be configured so that it further comprises a transition time table creation unit creating a transition time table by computing a summer time start date/time and a summer time end date/time in each of the plurality of years, based on the summer-time information from the summer-time information holding unit, and by storing the summer time start date/time and the summer time end date/time in each year into the transition time holding unit as one of the plurality of summer time transition times sequentially.

The above-mentioned time correction apparatus may be configured so that the transition time table creation unit creates the transition time table every time the image forming device is started.

The above-mentioned time correction apparatus may be configured so that the transition time table creation unit updates the transition time table when the summer-time information from the summer-time information holding unit is changed.

The above-mentioned time correction apparatus may be configured so that the transition time table creation unit first computes a summer time start date/time and a summer time end date/time of a year contained in the present time, and stores the summer time start date/time and the summer time end date/time into the transition time holding unit as a first summer time transition time.

The above-mentioned time correction apparatus may be configured so that the time determining unit acquires one of the plurality of summer time transition times from the transition time holding unit sequentially from a first summer time transition time among the plurality of summer time transition times.

The above-mentioned time correction apparatus may be configured so that the time determining unit determines whether the present time is within the summer time period, by acquiring one of the plurality of summer time transition times from the transition time holding unit one by one and comparing the present time with the acquired one of the plurality of summer time transition times respectively.

The above-mentioned time correction apparatus may be configured so that the summer-time information held by the summer-time information holding unit contains an input summer time transition time.

The above-mentioned time correction apparatus may be configured so that a date/time holding unit is provided to hold a date and time contained in the present time.

The image forming device having the above-mentioned time correction apparatus may be configured so that the image forming device comprises an image formation part which acquires from the time correction apparatus the corrected present time in which the summer-time information is reflected.

According to the time correction apparatus of the present invention, the amount of time correction in the summer time period can be set to an arbitrary amount that is in conformity with the newly adopted summer time system. Therefore, even if a summer time system in which the time correction requiring the amount of time correction other than one hour is adopted, the time correction apparatus of the present invention can set the amount of time correction for the summer time period to the required amount and can correct the present time properly, while there is no need for performing complicated operations to modify the software provided in the image forming device.

Moreover, it is possible to compare the present time with each of the plurality of summer-time transition times predetermined for the plurality of years respectively, for the determination of the summer time period. Therefore, according to the image forming device having the time correction apparatus of the invention, the time correction is carried out properly over the plurality of years so that the present time within the image forming device can be automatically corrected during the summer time period. Moreover, the continuous operation of the image forming device over two or more consecutive years can be allowed, while there is no risk of occurrence of a faulty time correction.

BRIEF DESCRIPTION OF THE DRAWINGS

Other objects, features and advantages of the present invention will be apparent from the following detailed description when reading in conjunction with the accompanying drawings.

DETAILED DESCRIPTION OF PREFERRED EMBODIMENTS

A description will now be given of the preferred embodiments of the invention with reference to the accompanying drawings.

Figure 1:
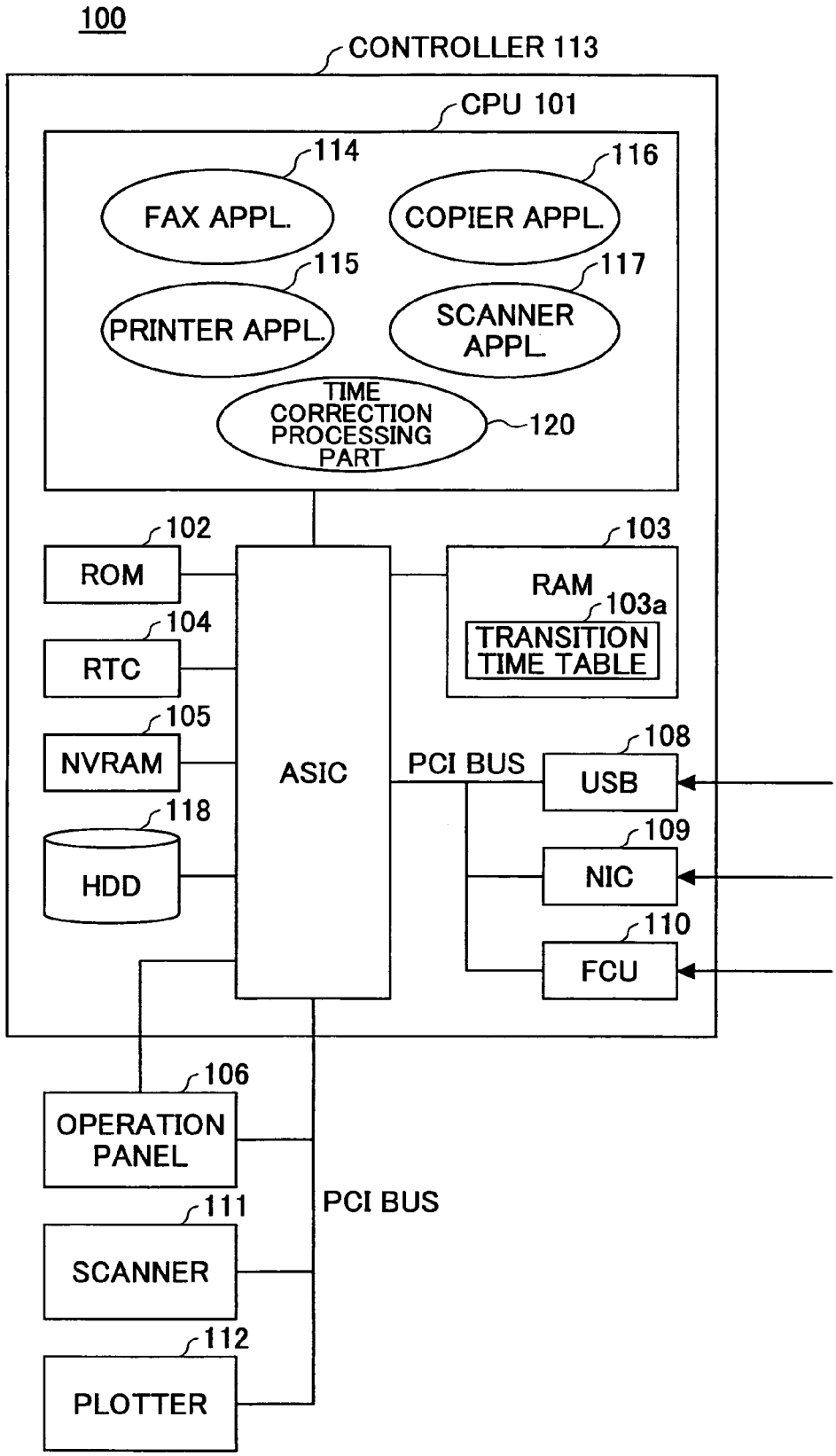
FIG. 1 is a block diagram showing the composition of an image forming device when the time correction apparatus in one embodiment of the invention is applied to the image forming device.

FIG. 1 shows the composition of an image forming device when the time correction apparatus in one embodiment of the invention is applied to the image forming device.

In the image forming device 100 of FIG. 1, the time correction apparatus of the present embodiment comprises the CPU 101, the ROM 102, the RAM 103, the RTC (real time clock) 104, the NVRAM 105, the operation panel 106, and the time correction processing part 120.

The time correction processing part 120 is software (application program) which is stored in the ROM 102 and operates by the CPU 101. The RAM 103 is a volatile memory, and a transition time table 103*a* is created in the RAM 103 by the time correction processing part 120 (the CPU 101).

The RTC 104 is a date/time holding unit holding the present date and time (for example, the day, the hour and the second included in the standard time). The NVRAM 105 is a device which stores input summer-time information which the user inputs from the operation panel 106.

The summer-time information stored in the NVRAM 105 includes, for example, the offset value of the time zone of the installation area of the image forming device 100 relative to the standard time zone, the summer time start date/time, the summer time end date/time, and the summer time correction time.

Figures 2, 3:
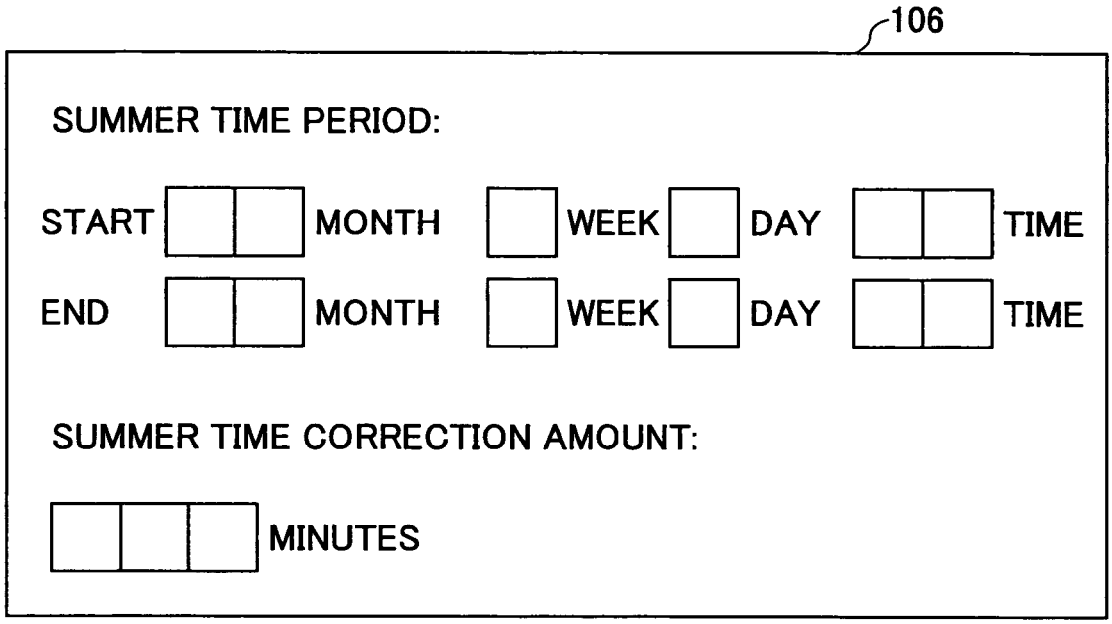
FIG. 2 is a diagram showing an example of the operation panel screen for performing summer-time information setting in the time correction apparatus in one embodiment of the invention.
FIG. 3 is a diagram showing an example of the transition time table in the time correction apparatus in one embodiment of the invention.

FIG. 2 shows an example of the operation panel screen for performing the summer-time information setting in the present embodiment.

The operation panel screen of FIG. 2 is displayed on the operation panel 106 in the image forming device 100 of FIG. 1.

On this operation panel screen, the user can set up the summer-time information on the NVRAM 105 by inputting the summer time start date/time, the summer time end date/time, and the summer time correction time.

As shown in FIG. 2, the user can specify, on the operation panel screen, the month, the week, the day and the time as the input summer time start date/time and the input summer time end date/time of the area in which the user resides. Moreover, the user can specify, on the operation panel screen, the summer time correction time (the amount of time correction) by inputting an arbitrary time quantity (in minutes).

FIG. 3 shows an example of the transition time table in the present embodiment.

As mentioned above, the transition time table 103*a* is created and stored in the RAM 103 by the time correction processing part 120 every time the image forming device is started.

In the transition time table 103*a* of FIG. 3, there are stored the values of a plurality of consecutive data items of summer time transition times for a plurality of consecutive years (from 2004 to 2007), assuming that the summer time start date/time for every year is 0:00 on last Sunday in March, and the summer time end date/time for every year is 1:00 on last Sunday in October.

All the time values of the transition time stored in the transition time table 103*a* of this embodiment are expressed in seconds (the elapsed seconds) which have passed from the reference time 0:00 on Jan. 1, 2000. For example, the first data item (the year 2004 summer time start date/time) of the transition time table 103*a* of FIG. 3 is 0:00 on last Sunday in March 2004, and this time is expressed in the elapsed seconds from the reference time 0:00 on Jan. 1, 2000.

The data items included in the transition time table 103*a* are a set of pairs of the two data items: the summer time start date/time and the summer time end date/time. A corresponding number of the pairs of the summer time start date/time and the summer time end date/time for a given number of years that can be stored are stored in the transition time table 103*a*.

When the transition time table 103*a* is created with the time values expressed in the elapsed seconds from the reference time 0:00 on Jan. 1, 2000, the time before the reference time 0:00 on Jan. 1, 2000 cannot be expressed, or it is expressed as a negative value.

In a case in which the need to express the time prior to the reference time 0:00 on Jan. 1, 2000 arises, it is possible to create a transition time table 103*a* by setting a certain time before 0:00 on Jan. 1, 2000 into the reference time.

Alternatively, a transition time table 103*a* in which the time value of each of the summer time transition times are expressed with a negative value may be created. It is appropriate that while the range to which the time correction apparatus of the invention is applied is taken into consideration, the oldest time that is applicable is set into the reference time.

Next, with reference to FIG. 1, FIG. 4 and FIG. 5, the processing operation which is performed by the time correction apparatus of the present embodiment will be explained.

Figure 4:
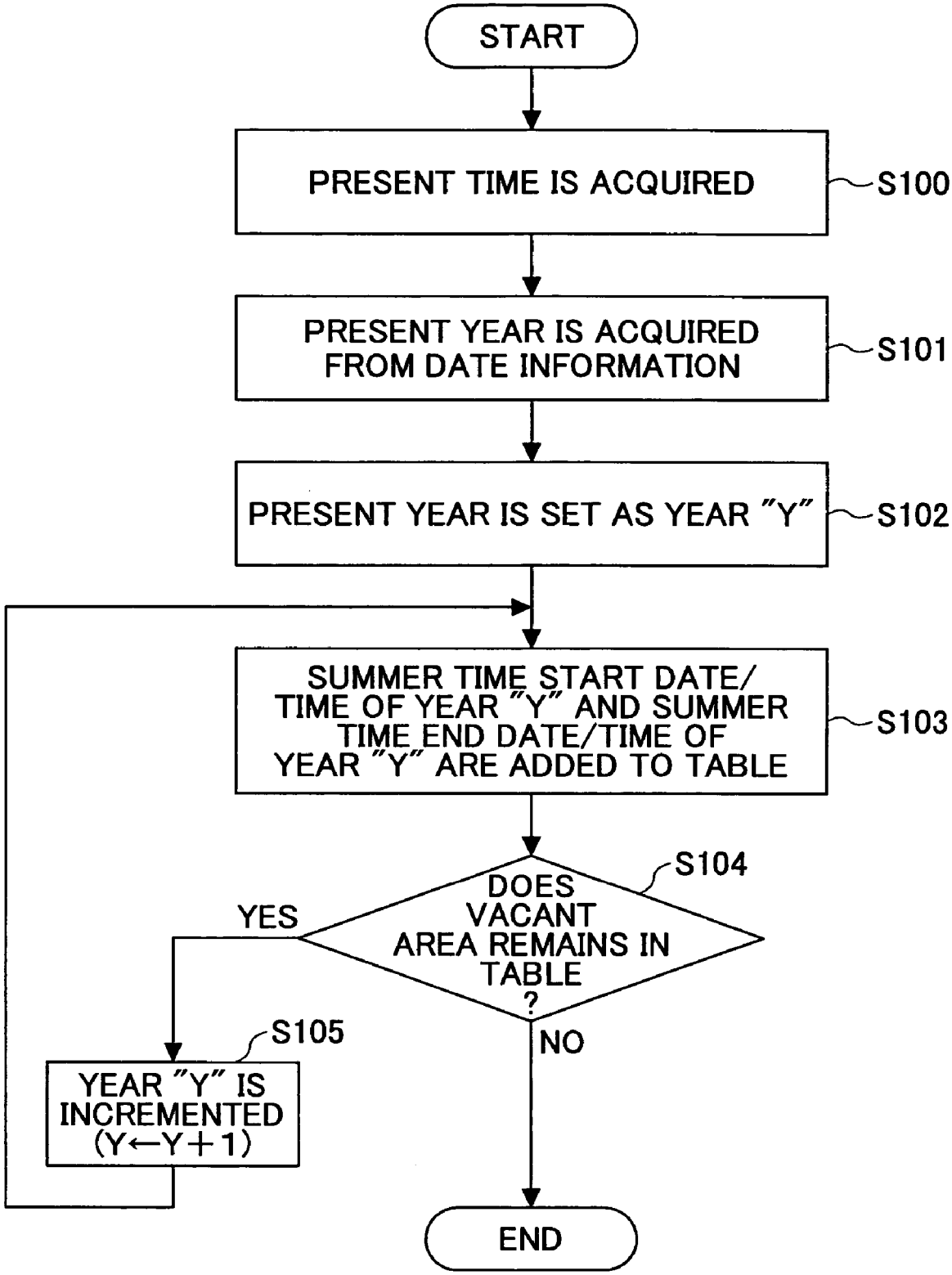
FIG. 4 is a flowchart for explaining the table creation processing which creates the transition time table in the time correction apparatus in one embodiment of the invention.

FIG. 4 is a flowchart for explaining the creation processing which creates the transition time table in the time correction apparatus in one embodiment of the invention.

When the power of the image forming device 100 of FIG. 1 is turned on and the image forming device 100 starts operation, the time correction processing part 120 (the CPU 101) starts execution of the transition time table creation processing of FIG. 4.

Upon start of the creation processing operation of FIG. 4, the CPU 101 acquires the present time (step S100). In this case, the CPU 101 acquires the present time from the RTC 104 which holds the present time. The date information (year, month, day) is included in the present time held by the RTC 104.

Next, the CPU 101 acquires the present year from the date information included in the present time (step S101).

Next, the CPU 101 sets up the acquired present year as the year (Y) concerned (step S102). From the year (Y) concerned, the calculation of a summer time start date/time and a summer time end date/time is started.

Next, the CPU 101 computes the time values of the summer time start date/time and the summer time end date/time of the year (Y) concerned (step S103).

In the step S103, the CPU 101 computes the month, the day, and the time of the year (Y) concerned based on the information of the month, the week, the day of the week, and the time of the summer time start date/time or end date/time in the summer-time information stored in the NVRAM 105.

Moreover, the CPU 101 converts the computed result into the elapsed seconds from the reference time 0:00 on Jan. 1, 2000, and adds the resulting value to the transition time table 103*a* in the RAM 103 as one data item. And the CPU 101 stores the updated transition time table 103*a* into the RAM 103.

There are various methods of computing the month, the day, and the time of the year (Y) concerned from the information of the month, the week, the day of the week, and the time in the summer-time information stored in the NVRAM 105.

An example of the calculation procedure for calculating the summer time start date/time in 2004 in the case in which the summer time start date/time is 0:00 on last Sunday in March will be explained.

Since the day of Jan. 1, 2000 is Saturday, it can be determined that Mar. 1, 2004 is Monday. Since Mar. 1, 2004 is Monday, it can be determined that the first Sunday in March, 2004 is Mar. 7, 2004. By adding seven to the day of March 7 repeatedly, the days of March 14, March 21, and March 28 are obtained as an effective date. It can be determined that the final Sunday in March 2004 is Mar. 28, 2004. Thus, the information of 0:00 on Mar. 28, 2004 can be computed from the information of 0:00 on last Sunday in March 2004. Therefore, the value of the elapsed seconds from 0:00 on Jan. 1, 2004 to 0:00 on Mar. 28, 2004 is stored in the transition time table 103*a*.

It is a matter of course that taking into consideration a leap year and a leap second is required for the above-described date calculation.

After the summer time start date/time and the end date/time of the year (Y) concerned are added to the transition time table 103*a*, the CPU 101 determines whether the available storage area in the transition time table 103*a* remains (step S104).

When it is determined that the available storage area in the transition time table 103*a* remains (YES of step S104), the CPU 101 increments the value of the year (Y) concerned (Y=Y+1) (step S105). And the control is shifted to the above step S103.

By repeating the processing of steps S103 and S104, the CPU 101 computes the values of the summer time start date/time and the end date/time of the subsequent years, and adds each data item to the transition time table 103*a*.

On the other hand, when it is determined with there is no available storage area in the transition time table 103*a* (NO of step S104), the CPU 101 terminates the creation processing for creating the transition time table 103*a*.

Figure 5:
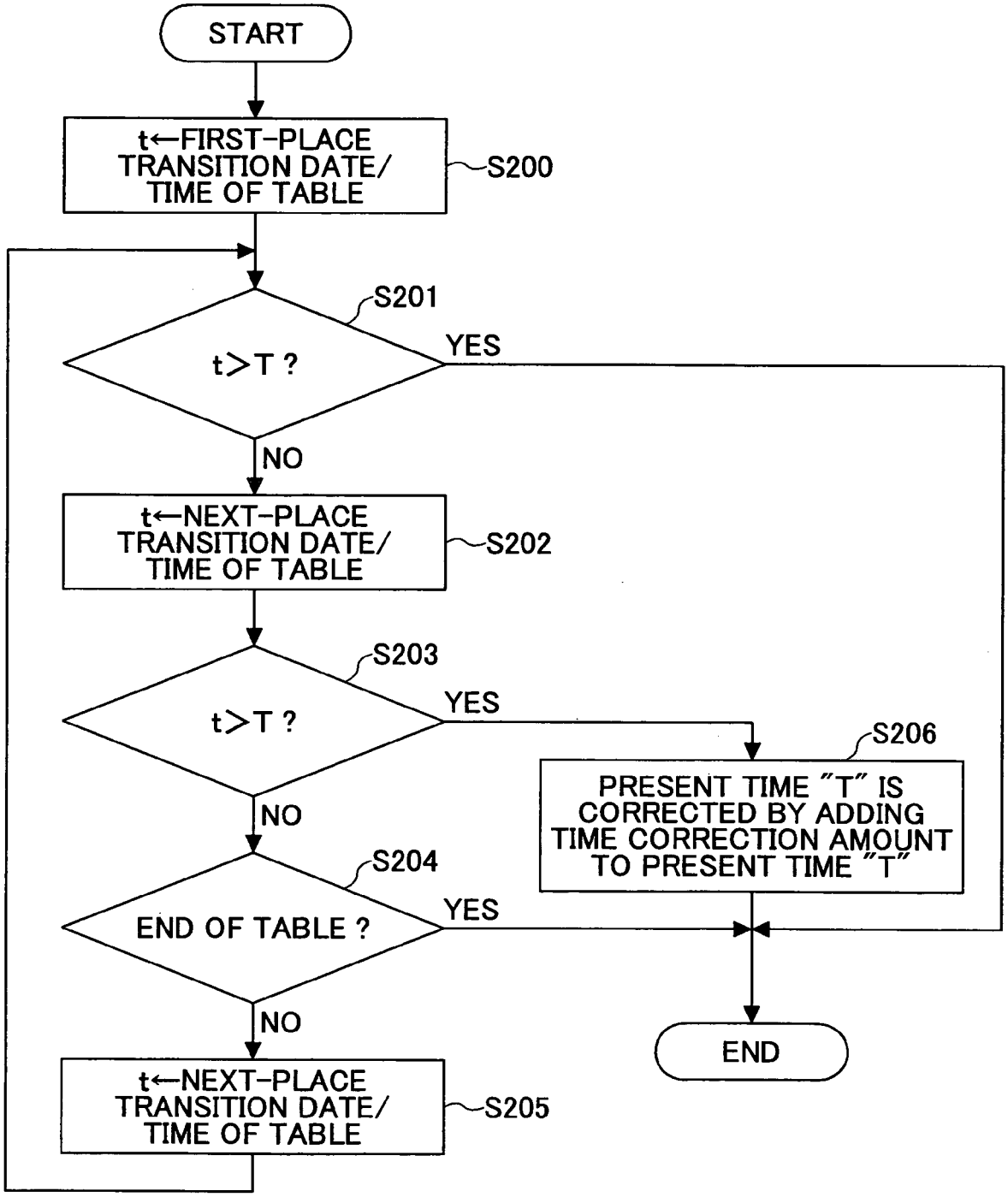
FIG. 5 is a flowchart for explaining the determination processing which determines the summer time period in the time correction apparatus in one embodiment of the invention.

FIG. 5 is a flowchart for explaining the determination processing which determines the summer time period in the time correction apparatus in one embodiment of the invention.

In the determination processing of FIG. 5, the time correction processing part 120 (the CPU 101) determines whether the present time (T) that is inputted from the RTC 104 to the time correction processing part 120 is within the summer time period.

Upon start of the determination processing of FIG. 5, the CPU 101 acquires the time (t) of the first-place data item of the transition time table 103*a* from the RAM 103 (step S200). The acquired time (t) indicates the summer time start date/time of the year concerned, and that numeric value is expressed in the elapsed seconds from 0:00 of Jan. 1, 2000.

Next, the CPU 101 determines whether the time (the summer time start date/time (t)) acquired at the step S200 is larger than the present time (T) by comparing them (step S201).

When the summer time start date/time (t) is larger than the present time (T) (YES of step S201), it is determined that the present time (T) is still before the summer time period, and the CPU 101 terminates the determination processing.

On the other hand, when the summer time start date/time (t) is smaller than the present time (T) (NO of step S201), it is determined that the present time (T) may be within the summer time period, and the control is shifted to the comparison of the summer time end date/time of the year concerned with the present time.

The CPU 101 acquires the time (t) of the next-place data item of the transition time table 103*a* (step S202). The acquired time (t) in this case is the summer time end date/time of the year concerned, and that numeric value is expressed in the elapsed seconds from 0:00 of Jan. 1, 2000.

Next, the CPU 101 determines whether the summer time end date/time (t) acquired at step S202 is larger than the present time (T) by comparing them (step S203).

When the summer time end date/time (t) is larger than the present time (T) (YES of step S203), it can be determined that the present time (T) is within the summer time period. The CPU 101 carries out the time correction of the present time to the corrected time for the summer time period by adding the summer time correction amount (the amount of time correction) obtained from the NVRAM 105, to the present time (T) (S206). After the time correction is completed, the CPU 101 terminates the determination processing.

On the other hand, when the summer time end date/time (t) is smaller than the present time (T) (NO of step S203), it can be determined that the present time (T) is after the summer time period.

In this case, the CPU 101 determines whether the time (t) acquired at step S202 is the last data item in the transition time table 103*a* (step S204).

In order to carry out the continuous operation of the image forming device 100 over two or more consecutive years without causing an error, the time correction apparatus of the present embodiment is configured so that each of the plurality of data items (the summer time transition times) for the plurality of consecutive years is acquired from the transition time table 103*a*, and each of the acquired data items (t) is compared with the present time (T) to determine whether the present time is within the summer time period.

When the time acquired at step S202 is the last data item in the transition time table 103*a* (YES of step S204), it can be determined that the time correction for the summer time period is no longer necessary. The CPU 101 terminates the determination processing.

On the other hand, when the time acquired at step S202 is not the last data item of the transition time table 103*a* (NO of step S204), the CPU 101 acquires the time (t) of the next-place data item of the transition time table 103*a* (step S205). The acquired time (t) is the summer time start date/time time of the next year. And the CPU 101 repeats the processing of the steps S201 to S206 mentioned above.

Next, with reference to FIG. 1, the operation of the image forming device 100 having the time correction apparatus of the present embodiment will be explained.

The image forming device 100 of FIG. 1 comprises the controller 113, the operation panel 106, the scanner 111, and the plotter 112.

In the controller 113, the CPU 101, the ROM 102, the RAM 103, the RTC 104, and the NVRAM 105 are connected together through the ASIC 107. The USB 108, the NIC (Network Interface Card) 109, and the FCU (Fax Control Unit) 110 are connected to the ASIC 107 via the PCI bus. The HDD 118 for storing image data is connected to the controller 113 via the ASIC 107.

The FAX application 114 is the software (application program) which is stored in the ROM 102 and performed by the CPU 101. When the FAX application 114 is performed, the image data of the transmitting original document read with the scanner 111 is temporarily stored in the RAM 103, and the FCU 110 is controlled so that the image data is transmitted to the FAX of the receiving-side device via a public telephone network.

After the transmission is completed, the FAX application 114 acquires the present time in which the summer-time information is reflected from the time correction processing part 120, and writes the time of completion of the transmission to the NVRAM 105.

The time of completion of the transmission is displayed on the operation panel 106 by the FAX application 114 in response to a command which is inputted from the operation panel 106 by the user. Therefore, the user can easily check the time of completion of the transmission in which the summer-time information is reflected.

Moreover, when the image data received from the FAX of the sending-side device via the public telephone network is temporarily stored in the RAM 103, the FAX application 114 acquires the present time in which the summer-time information is reflected from the time correction processing part 120 as the FAX reception time.

Then, when the received data stored in the RAM 103 is printed on a printing sheet using the plotter 112, the FAX application 114 prints the time information of the previously acquired FAX reception time to the portion near the head of the printing sheet through the image composition. Therefore, the user can easily check the FAX reception time in which the summer-time information is reflected.

Moreover, when the user designates the automatic transmission time using the operation panel 106, the FAX application 114 temporarily stores in the HDD 118 the image data of the transmitting original document read with the scanner 111.

When the automatic transmission time designated by the user is reached, the FAX application 114 reads the image data from the HDD 118 to the RAM 103, and the FCU 110 is controlled so that the image data is transmitted to the FAX of the receiving-side device via the public telephone network.

Thus, according to the image forming device 100 of the present embodiment, the time correction is carried out so that the present time within the image forming device is automatically corrected for the summer time of the area where the user resides by using the above-mentioned time correction apparatus. The user who uses the image forming device 100 of the present embodiment can manage the FAX transmission/receiving processing which is associated with the present time after the time correction is performed, and therefore the convenience of the user improves.

Moreover, in the image forming device 100 of FIG. 1, the printer application 115 is the software which is stored in the ROM 102 and performed by the CPU 101.

When the user sends a printing command from the host computer connected to the image forming device 100 through the USB 108 or the NIC 109, the image data is transmitted from the host computer to the image forming device 100 through the USB 108 or the NIC 109.

The printer application 115 is performed, the image data transmitted is temporarily stored in the RAM 103, and thereafter the image data is printed using the plotter 112 for the number of printing sheets according to the specification of the command for the image data concerned.

In accordance with another printing command by the user, the printer application 115 may store the transmitted image data from the RAM 103 into the HDD 118 without printing the transmitted image data. At this time, the printer application 115 acquires the present time in which the summer-time information is reflected from the time correction processing part 120, and writes the data transfer time at which the image data concerned is transmitted, to the HDD 118.

Moreover, the printer application 115 displays on the operation panel 106 the image data stored in the HDD 118 and the list of data transfer times at which the image data concerned was transmitted, in response to a command which is inputted from the operation panel 106 by the user. Then, the user views the list of data transfer times displayed on the operation panel 106 and designates which image data is to be printed. The printer application 115 prints only the image data which is designated by the user on the printing sheet using the plotter 112.

Thus, according to the image forming device 100 of the present embodiment, the time correction is carried out so that the present time within the image forming device is automatically corrected for the summer time of the area where the user resides by using the above-mentioned time correction apparatus. The user who uses the image forming device 100 of the present embodiment can recognize the image data for which the printing command is sent, as well as the data transfer time of the image data concerned which is associated with the present time after the time correction is performed, and therefore the convenience of the user improves.

Moreover, in the image forming device 100 of FIG. 1, the copier application 116 is the software which is stored in the ROM 102 and performed by the CPU 101.

When the copier application 116 is performed, the scanner 111 reads an image of the original document in response to a command which is inputted from the operation panel 106 by the user, and the read image data is temporarily stored in the RAM 103. Then, the image data is printed using the plotter 112 for the number of printing sheets according to the specification of the command for the image data concerned.

In accordance with another command inputted from the operation panel 106 by the user, the copier application 116 may store the image data concerned in the HDD 118 while the image data stored in the RAM 103 is printed on the printing sheet.

After the image data is stored in the HDD 118, the copier application 115 acquires the present time in which the summer-time information is reflected from the time correction processing part 120, and writes the data recording time at which the image data concerned is recorded, to the HDD 118.

Furthermore, in the image forming device 100 of FIG. 1, the scanner application 117 is the software which is stored in the ROM 102 and performed by the CPU 101.

When the scanner application 117 is performed, the scanner 111 reads an image of the original document in response to a data transfer command which is inputted from the operation panel 106 by the user, and the read image data is transmitted to the host computer connected to the USB 108 or the NIC 109. Moreover, when a data store command of the image data is inputted by the user, the read image data is stored in the HDD 118.

After the read image data is stored in the HDD 118, the scanner application 117 acquires the present time in which the summer-time information is reflected from the time correction processing part 120, and writes the data reading time at which the image data concerned is read, to the HDD 118.

The copier application 116 and the scanner application 117 display on the operation panel 106 the image data stored in the HDD 118 and the list of data reading times at which the image data concerned was read, in response to a command which is inputted from the operation panel 106 by the user. Then, the user views the list of data reading times displayed on the operation panel 106 and designates which image data is to be printed. Only the image data which is designated by the user is printed on the printing sheet using the plotter 112.

Thus, according to the image forming device 100 of the present embodiment, the time correction is carried out so that the present time within the image forming device is automatically corrected for the summer time of the area where the user resides by using the above-mentioned time correction apparatus. The user who uses the image forming device 100 of the present embodiment can recognize the image data stored in the image forming device, as well as the data reading time which is associated with the present time after the time correction is performed, and therefore the convenience of the user improves.

According to the time correction apparatus of the present invention, the amount of time correction for the summer time period can be set to an arbitrary amount as described above. Therefore, even if a summer time system in which the time correction requiring the amount of time correction other than one hour is adopted in the future, the time correction apparatus of the present embodiment can set the amount of time correction for the summer time period to the required amount, while there is no need for performing complicated operations to modify the software provided in the image forming device.

Moreover, it is possible to compare the present time with each of the plurality of summer-time transition times predetermined for the plurality of years respectively, for the determination of the summer time period. Therefore, according to the image forming device having the time correction apparatus of the present embodiment, the time correction is carried out properly over the plurality of years so that the present time within the image forming device can be automatically corrected during the summer time period. Moreover, the continuous operation of the image forming device over two or more consecutive years can be allowed, while there is no risk of occurrence of a faulty time correction.

The present invention is not limited to the above-described embodiments, and variations and modifications may be made without departing from the scope of the present invention.

Further, the present application is based on and claims the benefit of priority of Japanese patent application No. 2004-188588, filed on Jun. 25, 2004, and Japanese patent application No. 2005-155235, filed on May 27, 2005, the entire contents of which are hereby incorporated by reference.

What is claimed is:

1. A time correction apparatus provided for correcting a present time in an image forming device, the time correction apparatus comprising:

an input unit that inputs an input summer time start date/time, an input summer time end date/time, and an amount of time correction for a summer time period, wherein each of the summer time start date/time, the summer time end date/time, and the amount of time correction for the summer time period are modifiable and input by a user;

a summer-time information holding unit that holds summer-time information which contains the input summer time start date/time, the input summer time end date/time, and the amount of time correction;

a transition time table creation unit that creates a transition time table containing a plurality of summer time transition times of a plurality of years, by computing a summer time start date/time and a summer time end date/time for each of the plurality of years based on the summer-time information from the summer-time information holding unit and by storing the summer time start date/time and the summer time end date/time for each of the plurality of years into the transition time table;

a time determining unit that compares the present time with each of the plurality of summer time transition times in the transition time table, and determine whether the present time is within the summer time period, by determining whether the present time is in between a corresponding summer time start date/time and a corresponding summer time end date/time for each of the plurality of years in the transition time table, based on a result of the comparison; and a time correction unit that corrects the present time for the summer time period by adding, to the present time, the amount of time correction in the summer-time information from the summer-time information holding unit, in accordance with a determination result by the time determining unit.

2. The time correction apparatus of claim 1 wherein the transition time table creation unit creates the transition time table every time the image forming device is started.

3. The time correction apparatus of claim 1 wherein the transition time table creation unit updates the transition time table when the summer-time information from the summer-time information holding unit is changed.

4. The time correction apparatus of claim 1 wherein the transition time table creation unit first computes a summer time start date/time and a summer time end date/time of a year contained in the present time, and stores the summer time start date/time and the summer time end date/time into the transition time holding unit as a first summer time transition time.

5. The time correction apparatus of claim 1 wherein the time determining unit acquires one of the plurality of summer time transition times from the transition time holding unit sequentially from a first summer time transition time among the plurality of summer time transition times.

6. The time correction apparatus of claim 1 wherein the time determining unit determines whether the present time is within the summer time period, by acquiring one of the plurality of summer time transition times from the transition time holding unit one by one and comparing the present time with the acquired one of the plurality of summer time transition times respectively.

7. The time correction apparatus of claim 1 wherein the summer-time information held by the summer-time information holding unit contains an input summer time transition time.

8. The time correction apparatus of claim 1 wherein a date/time holding unit is provided to hold a date and time contained in the present time.

9. An image forming device having the time correction apparatus of claim 1 wherein the image forming device comprises an image formation part which acquires from the time correction apparatus the corrected present time in which the summer-time information is reflected.

10. The time correction apparatus of claim 5 wherein the time determining unit determines whether a summer time start date/time is smaller than the present time, and if so determines whether a summer time end date/time is larger than the present time.

* * * * *